US010085495B2

(12) United States Patent
Kitaura et al.

(10) Patent No.: US 10,085,495 B2
(45) Date of Patent: Oct. 2, 2018

(54) CLOTHING HAVING COOLING FUNCTION OR WARMING FUNCTION

(71) Applicant: Panasonic Corporation, Osaka (JP)

(72) Inventors: Hidetoshi Kitaura, Osaka (JP); Naomi Nishiki, Kyoto (JP); Kazuhiro Nishikawa, Osaka (JP); Kimiaki Nakaya, Osaka (JP); Atsushi Tanaka, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1221 days.

(21) Appl. No.: 13/762,768

(22) Filed: Feb. 8, 2013

(65) Prior Publication Data

US 2013/0205462 A1 Aug. 15, 2013

(30) Foreign Application Priority Data

Feb. 15, 2012 (JP) ..... 2012-030339
Nov. 22, 2012 (JP) ..... 2012-256497

(51) Int. Cl.
*F28D 17/00* (2006.01)
*F28F 7/00* (2006.01)
(Continued)

(52) U.S. Cl.
CPC ..... *A41D 13/005* (2013.01)

(58) Field of Classification Search
CPC ... F28F 21/02; F28F 23/00; F28D 2020/0013; F28D 2020/21; F28D 2020/006;
(Continued)

(56) References Cited

U.S. PATENT DOCUMENTS 4,035,606 A * 7/1977 Browder ..... A47C 7/021 219/211
4,061,898 A * 12/1977 Murray ..... A42B 1/008 219/211
(Continued)

FOREIGN PATENT DOCUMENTS

JP 11-1621 1/1999
JP 11-50313 2/1999
(Continued)

OTHER PUBLICATIONS

Office Action dated Oct. 25, 2016 in Japanese Patent Application No. 2012-256497.

*Primary Examiner* — Jason Thompson
(74) *Attorney, Agent, or Firm* — Wenderoth, Lind & Ponack, L.L.P.

(57) ABSTRACT

The clothing having a frontal land and a rear land includes: a thermal storage unit provided on at least one portion of the frontal land of the clothing; and a planar thermoconductive sheet located in a planar between the frontal land and the rear land, the planar thermoconductive sheet having a thermal conduction path to the thermal storage unit, and the planar thermoconductive sheet being higher in thermoconductivity than the frontal land and the rear land. The planar thermoconductive sheet includes a resin component and graphite particles. Basal plane of each graphite particle is parallel to the direction of the plane of the planar thermoconductive sheet.

6 Claims, 9 Drawing Sheets

(51) Int. Cl.
*A42B 1/00* (2006.01)
*A41D 13/005* (2006.01)

(58) Field of Classification Search
CPC .... F28D 20/021; F28D 20/023; F28D 20/025; F28D 20/026; F28D 2020/004; F28D 2020/008; F28D 2020/0017; F28D 20/0034; A41D 13/005
USPC ..... 428/402; 2/7, 81, 8.1, 458; 165/46, 10
See application file for complete search history.

(56) References Cited

U.S. PATENT DOCUMENTS 4,147,921 A * 4/1979 Walter ..... A61F 7/007 219/211
4,854,319 A * 8/1989 Tobin ..... A61F 7/10 2/171.2
4,856,294 A * 8/1989 Scaringe ..... A41D 13/0055 165/46
5,787,505 A * 8/1998 Piwko ..... A41D 13/0051 2/115
5,863,467 A 1/1999 Mariner et al.
6,185,744 B1 * 2/2001 Poholski ..... A41D 13/0058 2/102
6,363,527 B1 * 4/2002 Biermann ..... F41H 1/02 2/2.5
6,755,852 B2 * 6/2004 Lachenbruch ..... A61F 7/106 607/108
7,458,106 B2 * 12/2008 Yue ..... A41D 19/01535 2/159
8,771,330 B1 * 7/2014 Roper ..... A61F 7/00 165/46
2002/0158332 A1 * 10/2002 Masayuki ..... H01L 23/3737 257/712
2003/0006633 A1 * 1/2003 Clothier ..... A47C 1/12 297/180.12
2004/0055072 A1 3/2004 Lee
2004/0262584 A1 * 12/2004 Bonnet ..... H01M 8/0213 252/511
2006/0011336 A1 * 1/2006 Frul ..... F28F 3/12 165/185
2007/0107872 A1 * 5/2007 Miyazaki ..... H01L 23/367 165/80.3
2010/0194179 A1 * 8/2010 Waltz ..... B60T 5/00 301/6.91

FOREIGN PATENT DOCUMENTS

JP 2002-309414 10/2002
JP 3130887 4/2007
JP 2009-097106 5/2009

* cited by examiner

CLOTHING HAVING COOLING FUNCTION OR WARMING FUNCTION

BACKGROUND

1. Technical Field

The present invention relates to a clothing having a cooling function or warming function. The invention relates particularly to a clothing using a planar thermoconductive sheet made of an anisotropic thermoconductive composition excellent in thermoconductivity.

2. Background Art

Hitherto, as wears that workers wear for work in a high-temperature environment, wears having a cooling function have been developed. For example, suggested is a wear or the like into which a coolant is set in order to cool the body of a worker (see, for example, Japanese Patent Laid-Open Publication No. 2002-309414).

In a case where workers work in a low-temperature environment, the workers wear heavy clothes to heighten a heat-retention function, use a disposable heating pad to be kept warm, or take other measures.

However, when a person attempts to set a coolant as described above directly to a surface of a wear that contacts the body to cool the body, only the body surface contacting the coolant is cooled. However, other portions of the body are not easily cooled. Thus, about the whole of the body, the body temperature turns into an unbalanced state. Additionally, it is unavoidable to set coolants to respective surfaces of the body that are to be cooled. Thus, the wear may unfavorably become expensive. When many coolants are set in such a way, the wear becomes heavy accordingly so that the person comes not to move easily.

When a worker wears heavy clothes in a low-temperature environment, the worker is declined in working performance. When a worker uses disposable heating pads to warm the body, it is indispensable to set the pads to wear portions corresponding to respective body portions to be warmed. Thus, the wear becomes expensive and heavy to disturb the movement of the worker.

SUMMARY OF THE INVENTION

Thus, an object of the present disclosures is to provide a clothing having a cooling function or warming function and makes it possible to cool or warm a wider area of a user's body while a smaller volume of a coolant or a heating element is used.

The clothing having a frontal land and a rear land according to the disclosures, includes:

a thermal storage unit fitted to at least one portion of the frontal land side of the clothing; and a planar thermoconductive sheet located in a planar between the frontal land and the rear land, the planar thermoconductive sheet having a thermal conduction path to the thermal storage unit, and the planar thermoconductive sheet being higher in thermoconductivity than the frontal land and the rear land, wherein the planar thermoconductive sheet includes a resin component and graphite particles, and basal plane of each graphite particle is parallel to the direction of the plane of the planar thermoconductive sheet.

The clothing has a frontal land and a rear land. Further, the clothing includes: a thermal storage unit; and a planar thermoconductive sheet located between the frontal land and the rear land, the planar thermoconductive sheet having a thermal conduction path to the thermal storage unit, and the planar thermoconductive sheet having a high thermoconductivity in the plane. In this clothing, a difference in temperature is generated between the body surface temperature of a person wearing the clothing and a coolant or heating element as the thermal storage unit. Thermal conduction generated by this temperature difference is introduced through the planar thermoconductive sheet having a high thermoconductivity in the plane of the sheet, so that the body surface temperature of the person can be controlled to a comfortable temperature.

BRIEF DESCRIPTION OF THE DRAWINGS

The present invention will become readily understood from the following description of preferred embodiments thereof made with reference to the accompanying drawings, in which like parts are designated by like reference numeral and in which.

DETAILED DESCRIPTION OF THE EMBODIMENTS

Figure 1B:
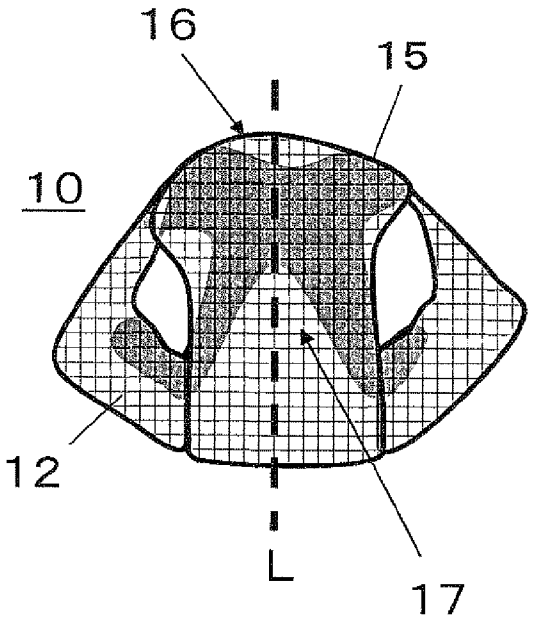
FIG. 1B is a perspective view of the wear obtained when a planar thermoconductive sheet is viewed from a rear land side of the wear.

The clothing having a frontal land, a rear land according to a first aspect includes:

a thermal storage unit provided on at least one portion of the frontal land of the clothing; and a planar thermoconductive sheet located in a planar between the frontal land and the rear land, the planar thermoconductive sheet having a thermal conduction path to the thermal storage unit, and the planar thermoconductive sheet is higher in thermoconductivity than the frontal land and the rear land, wherein the planar thermoconductive sheet includes a resin component and graphite particles, and basal plane of each graphite particle is parallel to the direction of the plane of the planar thermoconductive sheet.

Further, as a clothing of a second aspect, in the first aspect, the planar thermoconductive sheet may be located into a line provided from the thermal storage unit along two directions or four directions.

Further, as a clothing of a third aspect, in the first aspect, the planar thermoconductive sheet may be made from an anisotropic thermoconductive composition, the planar thermoconductive sheet that includes:

scaly graphite particles; and a matrix resin component in which the scaly graphite particles are dispersed, wherein the scaly graphite particles has an average aspect ratio a/c of 30 or more, and "a" ranging from 1 μm to 30 μm, when "a" represents a maximum diameter of a line lain on the basal planes of the particles, and "c" represents a thickness of the particles in a direction orthogonal to the basal planes, and the content of the scaly graphite particles is more than 40% by mass and 90% by mass or less.

Further, as a clothing of a fourth aspect, in the third aspect, the scaly graphite particles has a ratio a/b ranging from 1 to 20, when "b" represents a length of a line lain on the basal planes, the line of "b" is orthogonal to the line of "a".

Further, as a clothing of a fifth aspect, in the third aspect, a smaller angle θ out of angles made between the basal planes of the scaly graphite particles and the plane of the sheet may be 1° or more and 30° or less on average.

Further, as a clothing of a sixth aspect, in the first aspect, the planar thermoconductive sheet may be a sheet made of graphite.

Further, as a clothing of a seventh aspect, in the first aspect, the planar thermoconductive sheet may have a thickness ranging from 0.1 mm to 1 mm.

Further, as a clothing of an eighth aspect, in the first aspect, the planar thermoconductive sheet may be located in a portion of the clothing other than a central upper portion of the clothing.

Further, as a clothing of a ninth aspect, in the first aspect, the planar thermoconductive sheet may be located in a portion of the clothing other than a central lower portion of the clothing.

Further, as a clothing of a tenth aspect, in the first aspect, the thermal storage unit(s) may be provided on a plurality of portions of the frontal land of the clothing.

Further, as a clothing of an eleventh aspect, in the first aspect, the thermal storage unit may be a coolant.

Further, as a clothing of a twelfth aspect, in the first aspect, the thermal storage unit may be a heating element.

Further, as a clothing of a thirteenth aspect, in the first aspect, the clothing may be any one selected from the group consisting of wears, hats, caps, and helmets.

Referring to the attached drawings, a description will be made about wears according to Embodiments of the invention. In all of the drawings, the same reference numbers are attached to substantially the same members, respectively.

Embodiment 1

Figure 1A:
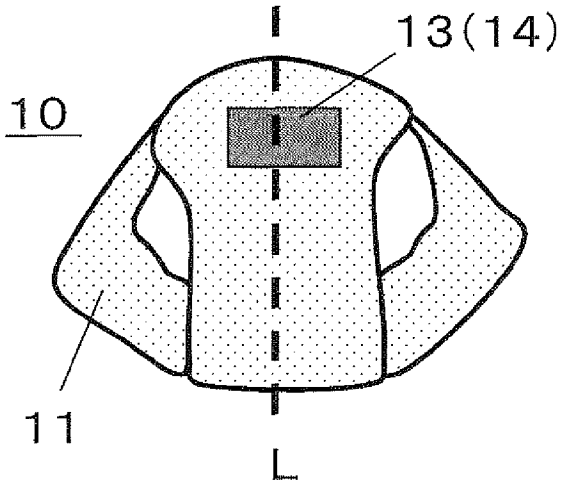
FIG. 1A is a plan view of a frontal land side of a wear according to Embodiment 1.
Figure 2:
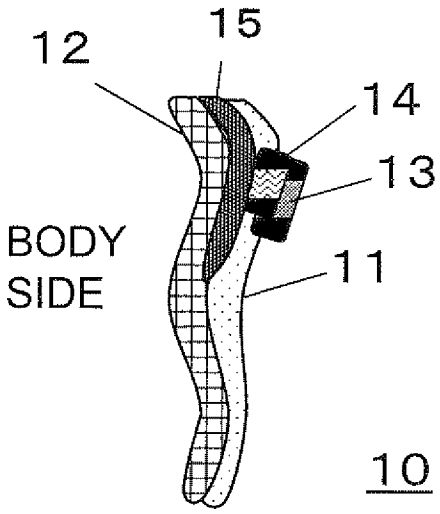
FIG. 2 is a sectional view illustrating a cross sectional structure of the wear according to Embodiment 1.
Figure 3B:
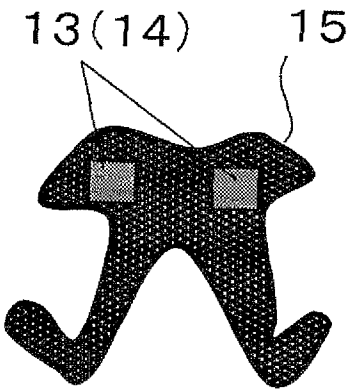
FIG. 3B is a plan view of a planar thermoconductive sheet and thermal storage units of still another example.
Figure 3A:
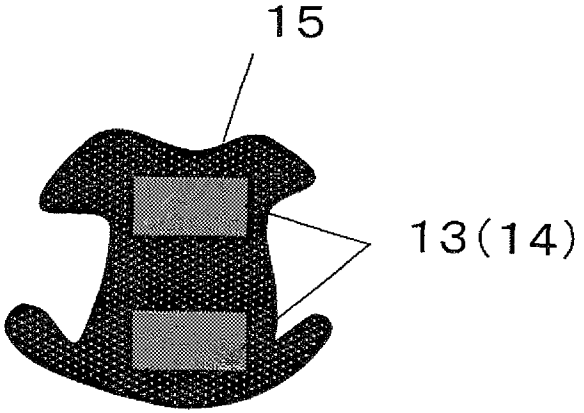
FIG. 3A is a plan view of a planar thermoconductive sheet and thermal storage units of another example.

FIG. 1A is a plan view of a frontal land 11 side of a wear 10 according to Embodiment 1, and FIG. 1B is a perspective view of the wear 10 obtained when a planar thermoconductive sheet 15 is viewed from a rear land 12 side of the wear 10. FIG. 2 is a sectional view illustrating a cross sectional structure of the wear 10 according to Embodiment 1. FIG. 3A is a plan view of a planar thermoconductive sheet of another example and thermal storage units, and FIG. 3B is a plan view of a planar thermoconductive sheet of still another example and thermal storage units.

Any one of the wears 10 according to Embodiment 1 has thermal storage unit(s) 14 set to at least one portion of the front land 11 side of the wear 10, and the planar thermoconductive sheet 15, which is located between the frontal land 11 and the rear land 12 of the wear 10. The planar thermoconductive sheet 15 also has a thermoconductive path to the thermal storage unit(s) 14, and the planar thermoconductive sheet 15 is higher in thermoconductivity than the frontal land 11 and the rear land 12. This thermal storage unit 14 is a coolant or a heating element. The thermal storage unit 14 is held in a storage pocket 13. According to this wear 10, thermal conduction between a wearing person of the wear 10 and the thermal storage unit 14 through the planar thermoconductive sheet 15 is generated by a difference between the body surface temperature of the wearing person and the temperature of the thermal storage unit 14. Thus, thermal conduction between a wearing person of the wear 10 and the thermal storage unit 14 through the planar thermoconductive sheet 15 may be used to control the body surface temperature of the wearing person. Specifically, when the thermal storage unit 14 is a coolant, heat from the wearing person is conducted through the planar thermoconductive sheet 15 to the coolant. When the thermal storage unit 14 is a heating element, heat from the heating element 14 is conducted through the planar thermoconductive sheet 15 to the wearing person so that the body surface temperature of the wearing person can be controlled into a comfortable temperature.

Hereinafter, each of the constituent members constituting the wear 10 will be described.

<Wear>

The external form and the material of the body of the wear 10 are not particularly limited. FIGS. 1A and 1B illustrate, as an external form of the wear 10, a vest form. However, the form is not limited thereto. Thus, the wear 10 may have an external form of a shirt, a jacket or some other. The vest in FIGS. 1A and 1B are opened at its portions through which arms are passed. Its central portion corresponds to the back side of the wear, and its right and left portions correspond to the front side of the wear. The material of the frontal land 11 and the rear land 12 of the wear 10 may be, for example, polyester.

<Thermal Storage Unit>

A coolant or heating element may be used as a thermal storage unit 14. The temperature of the coolant or heating element is made lower or higher than the body surface temperature of the wearing person, and can generate a temperature-difference from the body surface temperature of the wearing person. The coolant and the heating element may each be any ordinarily usable member. It is sufficient for the present invention that only one thermal storage unit 14 is set. However, as illustrated in FIGS. 3A and 3B, two or more thermal storage units 14 may be set. The direction in which the two or more thermal storage units 14 are arranged may be a direction along the wearing person's backbone (FIG. 3A), or a direction perpendicular to the backbone (FIG. 3B).

Furthermore, when only the thermal storage unit 14 is directly set to the wear 10, the external appearance may become poor or the frontal land 11 of the wear 10 may be damaged. Thus, as illustrated in FIGS. 1A and 1B and FIGS. 2A and 2B, the storage pocket(s) 13 may be attached onto the frontal land 11, and the thermal storage unit(s) 14 may be located into the pocket(s) 13.

<Planar Thermoconductive Sheet>

The planar thermoconductive sheet 15 is located between the frontal land 11 and the rear land 12 of the wear 10. Also, the planar thermoconductive sheet 15 has a thermoconductive path to the thermal storage unit(s) 14, and is higher in thermoconductivity than the frontal land 11 and the rear land 12. This planar thermoconductive sheet 15 is a member in a sheet form for conducting heat into the sheet-plane. This planar thermoconductive sheet 15 contacts the thermal storage unit 14 directly or indirectly to attain thermal conduction in the plane between the wearing person of the wear 10 and the thermal storage unit 14.

As illustrated in FIG. 1B, the planar thermoconductive sheet 15 may be located to avoid a blade bone portion 16 of the wear 10 (central upper portion of the wear). Any blade bone projects out; thus, the adhesiveness of the planar thermoconductive sheet 15 to the portion of the blade bone becomes poor. For this reason, by designing the wear to avoid location into the blade bone portion, the planar thermoconductive sheet 15 can be formed to contact the body. The planar thermoconductive sheet 15 may be located to avoid a backbone lower portion 17 in the back lower portion of the wear 10 (central lower portion of the wear). When the wearing person bends down, the backbone lower portion 17 of the back lower portion is dented. Thus, by designing the planar thermoconductive sheet 15 to avoid location into this portion, the sheet can be formed to contact the body in the same manner as described above. By boring the wear at the backbone lower portion 17, the wear can be made light. Without boring the wear at the backbone lower portion 17, the planar thermoconductive sheet 15 may be located over the whole of the back (FIG. 3A). In this case, the planar thermoconductive sheet 15 is spread in a slenderly rectangular line form from each of the storage pockets 13 into four directions. The planar thermoconductive sheet 15 needs only to be spread in a line form toward at least two directions. In the case of adopting, against this manner, the manner of making the sheet 15 not into any line form but into a single-square-sheet form, heat is not shifted or spread far away.

The planar thermoconductive sheet 15 is made of a material excellent in thermoconductivity in the plane of the sheet 15. The material may contain, for example, graphite.

The planar thermoconductive sheet 15 may be made of an anisotropic thermoconductive composition containing scaly graphite particles, and a matrix resin component in which the graphite particles are dispersed. When shear force or pressure is applied to this anisotropic thermoconductive composition, basal planes of the scaly graphite particles have a property of being oriented in the in-plane. When the scaly graphite particles are oriented in the in-plane, the anisotropic thermoconductive composition comes to exhibit a larger thermoconductivity in the in-plane. When this anisotropic thermoconductive composition is used for the planar thermoconductive sheet, the basal planes of the scaly graphite particles are oriented in the in-plane of the planar thermoconductive sheet so that an excellent thermoconductivity is exhibited in the in-plane.

Furthermore, the planar thermoconductive sheet 15 may be a sheet different from the anisotropic thermoconductive composition sheet; thus, the sheet 15 may be a graphite sheet, which contains no matrix resin component and has a graphite proportion of 100%.

<Scaly Graphite Particles>

The maximum diameter of the basal plane of each of the scaly graphite particles is represented by a and the thickness of the particle in the direction orthogonal to the basal plane is represented by c; on average, the ratio of the maximum diameter a (hereinafter referred to as the long diameter a) to the thickness c of the scaly graphite particle (a/c) is 30 or more, and the long diameter a is 1 μm or more and 30 μm or less. When the maximum diameter of the basal plane orthogonal to the long diameter a is represented by b (the orthogonal maximum diameter will be referred to as the shorter diameter), the ratio of the long diameter a to the short diameter b (a/b) is preferably 1 or more and 20 or less. The scaly graphite particles have such a peculiar shape. Thus, when the scaly graphite particles are oriented in the in-plane in the anisotropic thermoconductive composition, the probability of particle contact with each other becomes high. Further, the contact area between the particles at the contact portions also becomes large. Accordingly, a thermal conduction path would be able to be efficiently formed.

Figure 4:
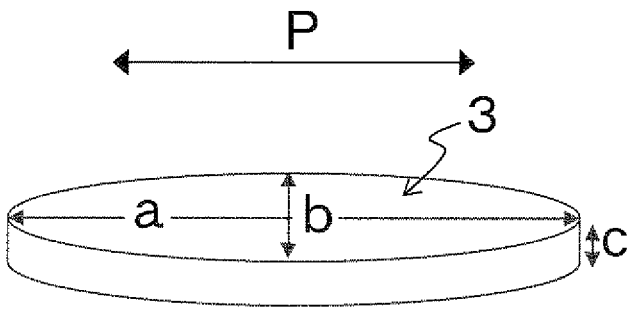
FIG. 4 is a schematic view illustrating the shape of a scaly graphite particle.

As illustrated in FIG. 4, the long diameter a of the scaly graphite particles is the maximum diameter of the graphite particle 3 in a direction P (direction by the arrow) parallel to the basal plane of the graphite particle 3. The short diameter b of the scaly graphite particle 3 is the maximum value of the width of the scaly graphite particle 3 orthogonal to the long diameter a. The ratio a/b of the long diameter a to the short diameter b, which may also be referred to as the aspect ratio, may be 1. In this case, the long diameter a and the short diameter b are compatible with each other. As illustrated in FIG. 4, the thickness c of the scaly graphite particle 3 is the maximum diameter of the particle 3 in the direction orthogonal to the basal plane.

The content of the scaly graphite particles in the whole of the anisotropic thermoconductive composition is controlled to more than 40% by mass and 90% by mass or less. When the content is in this range, the scaly graphite particles contact each other remarkably so that the composition is nonlinearly improved in thermoconductivity. In other words, in the case of using the scaly graphite particles having the above-mentioned shape, a planar thermoconductive sheet can be obtained which sufficiently exhibits a far higher thermoconductivity even when the amount of the particles is smaller than ordinary scaly graphite particles used in the prior art.

In the planar thermoconductive sheet in which the anisotropic thermoconductive composition is shaped into a sheet form, a smaller angle θ made between the individual basal planes of the scaly graphite particles and the plane of the sheet is preferably 1° or more and 30° or less on average. When the scaly graphite particles having an a/c ratio of 30 or more are oriented to give an angle θ of 30° or less, a planar thermoconductive sheet is obtained which has a very high anisotropic thermoconductivity. The use of such a planar thermoconductive sheet makes the following possible: when the sheet is located between the rear land and the frontal land of the wear, a thermal conduction path is created for diffusing heat from the wearing person effectively three-dimensionally, or for conducting heat effectively three-dimensionally to the wearing person.

<Production of the Scaly Graphite Particles>

The above-mentioned scaly graphite particles, which have a long diameter a of 1 μm or more and 30 μm or less and an a/c ratio of 30 or more, can be obtained, for example, by pulverizing a graphite film. Alternatively, the particles may be obtained by processing natural graphite into the form of scales having a long diameter a of 1 μm or more and 30 μm or less and an a/c ratio of 30 or more. Scaly graphite particles of a single species may be used alone. Scaly graphite particles of a plurality of species may be used in a mixture form as far as the particles satisfy the above-mentioned requirements about the long diameter a and the a/c ratio.

The graphite film as a precursor can be obtained by firing a polymer film at 2400° C. or higher, preferably a high temperature of 2600 to 3000° C. under the flow of an inert gas, thereby graphitizing the film. The firing may be performed at one stage, or may be performed at two or more stages by varying the firing temperatures in accordance with the stages. The inert gas is not particularly limited, and is preferably, for example, nitrogen or argon, which is inexpensive. The firing period is not particularly limited, and is preferably, for example, from 2 to 6 hours.

The thickness of the polymer film that has not yet been graphitized may be appropriately selected corresponding to the thickness c of the scaly graphite particles. The thickness is, for example, 400 μm or less, and is preferably from 10 to 200 μm. Even when a relatively thick polymer film is used as a starting material, thinner scaly graphite particles can be obtained since interlaminar exfoliation of graphite is caused when a graphite film obtained from the thick film is pulverized.

Preferred examples of the polymer film include polyimide, polyamideimide, polyoxadiazole, polybenzothiazole, polybenzobisthiazole, polybenzoxazole, polybenzobisthiazole, poly(p-phenyleneisophthalamide), poly(m-phenylenebenzoimidazole), poly(phenylenebenzobisimidazole), polythiazole, and poly(p-phenylenevinylene). The method for making these materials into a film is not particularly limited. These materials may be used alone, or in combination of two or more thereof. For example, it is allowable to graphitize different films of a plurality of species, pulverize the graphitized films, and then mix the pulverized films with each other, or make materials of a plurality of species into a composite material or an alloy, make the composite material or alloy into a film form, and then graphitize the film.

By pulverizing the resultant graphite film, scaly graphite particles are obtained. The method for the pulverization is not particularly limited, and is preferably a method of causing graphite particles to collide with each other, or a method of causing graphite particles to physically collide with a medium material high in hardness. Examples of this method include a ball mill method, a nanomizer method, and a jet mill method.

The thickness of the graphite film to be pulverized may be appropriately selected in accordance with a desired thickness c of the scaly graphite particles. The thickness is, for example, from 1 to 100 μm.

When natural graphite is processed, it is preferred to conduct a pre-treatment of immersing natural graphite into sulfuric acid, and heating the system to expand interlaminar spaces of graphite. By applying, after such a treatment, shear force to the expanded graphite, interlaminar exfoliation is promoted so that scaly graphite particles having an average thickness c of 1 μm or less can be obtained.

<Shape of the Scaly Graphite Particles>

The scaly graphite particles have, for example, a shape illustrated in FIG. 4. As described above, the shape should satisfy the requirements that the long diameter a is 1 μm or more and 30 μm or less, and the a/c ratio is 30 or more.

If the a/c ratio is less than 30, contact portions between the graphite particles are decreased to reduce the effect of improving the anisotropic thermoconductivity. The a/c ratio is more preferably 80 or more to increase the number of the contact portions between the particles and further increase the contact area between the particles in each of the contact portions. The a/c ratio is preferably 200 or less, more preferably 150 or less to keep the shape of the particles in the matrix resin component.

If the long diameter a is less than 1 μm, it is difficult to orient the scaly graphite particles in the matrix resin component. Even when the composition is shaped into a sheet form by, for example, extrusion forming or rolling, it is difficult to keep sufficiently the number of the contact portions between the scaly graphite particles and the contact area between the particles. If the long diameter a is larger than 30 μm, the dispersibility of the graphite particles in the matrix resin component is declined so that the planar thermoconductive sheet cannot gain a sufficient thermoconductivity. The average long diameter ranges more preferably from 3 to 25 μm to make the orientation of the graphite particles easy and further keep a good dispersibility of the particles in the matrix resin component.

Since the scaly graphite particles have a long diameter a of 30 μm or less and an a/c ratio of 30 or more, the thickness c is small and is at most 1 μm. As far as the particles have such a thinness, the ratio of the average long diameter a to the short diameter b of the scaly graphite particles (a/b) is not particularly limited. The a/b ratio is preferably 1 or more and 20 or less. If the a/b ratio is larger than 20, it may be difficult to keep the shape of the scaly graphite particles in the matrix resin component.

Each of the long diameter a, the short diameter b, and the thickness c is the average of values of 20 of the scaly graphite particles. In other words, about 20 particles selected at will from the scaly graphite particles, the respective long diameters a, the respective short diameters b and the respective thicknesses c are measured, and further the respective a/b ratios and the respective a/c ratios are calculated. The average of each value is then calculated. The long diameter a, the short diameter b and the thickness c of the scaly graphite particles can be measured by use of a scanning electron microscope.

When a graphite film is pulverized to yield scaly graphite particles, it is presumed that the particle size distribution of the scaly graphite particles is a normal distribution or a distribution close thereto. It is therefore desired to select, from the particles, 20 particles each having a long diameter a having an error of 30% or less relative to a median diameter about a cumulative volume of 50%, the median diameter being obtained by a laser diffraction type particle size distribution meter, and then calculate the average of each of the parameters.

Scaly graphite particles of two or more species that are different from each other in particle size distribution may be mixed with each other. Even in such a case, the mixture may be used without any limitation as far as the mixture satisfies requirements that the average value of the long diameters a of the particles in the mixture is 1 μm or more and 30 μm or less and the average value of the a/c ratio thereof is 30 or more.

<Matrix Resin Component>

The matrix resin component is not particularly limited, and may be any one selected from various thermoplastic resins or elastomers. The component may be a mixture of a thermoplastic resin having no rubbery elasticity and an elastomer. The component is in particular preferably an elastomer. The component is also preferably a resin component containing an elastomer in a proportion of 50% by mass or more.

Examples of the thermoplastic resin include styrene-based polymers such as a styrene-acrylonitrile copolymer, a styrene-maleic anhydride copolymer, and a (meth)acrylate-styrene copolymer; rubber-reinforced resins such as an ABS resin and an AES resin; olefin-based polymers such as polyethylene, polypropylene, an ethylene-vinyl acetate copolymer, an ethylene-vinyl alcohol copolymer, and polyethylene chloride; vinyl chloride-based polymers such as polyvinyl chloride, an ethylene-vinyl chloride copolymer, and polyvinylidene chloride; (meth)acrylate polymers such as polymethyl methacrylate; polyamides; imide-based polymers such as polyimide, polyamideimide, and polyetherimide; polyester-based polymers such as polyethylene terephthalate and polybutylene terephthalate; polyacetal; polycarbonate; polyarylate; polyphenylene ether; polyphenylene sulfide; fluorine resins such as polytetrafluoroethylene and polyvinylidene fluoride; ketone-based polymers such as polyetherketone and polyetheretherketone; sulfone-based polymers such as polysulfone and polyethersulfone; urethane polymers; and polyvinyl acetate. These may be used alone or in any combination of two or more thereof. Two or more thereof may be used in the state of being alloyed.

The elastomer is not particularly limited. Examples thereof include chloroprene rubber, isoprene rubber, natural rubber, styrene-butadiene rubber, butadiene rubber, butyl rubber, ethylene-propylene rubber, ethylene-propylene-diene rubber (EPDM), nitrile rubber, urethane rubber, acrylic rubber, silicone rubber, fluorine rubber, and hydrogenated nitrile rubber. These may be used alone or in any combination of two or more thereof.

<Additives>

The anisotropic thermoconductive composition may contain various additives besides the scaly graphite particles and the matrix resin component. When the anisotropic thermoconductive composition is particularly a rubber composition containing an elastomer, various additives may be used. The additives for the rubber composition are not particularly limited. Examples thereof include a crosslinking agent for crosslinking the rubber component, carbon black (such as Ketjen Black or acetylene black), which improves the mechanical strength of the rubber component, and a plasticizer used in an appropriate amount to adjust the hardness of the rubber. If necessary, the following may be added to the composition: a vulcanization aid such as stearic acid, a deterioration preventive, an oil, a lubricant, and inorganic particles (such as silica and alumina particles).

It is preferred to add, as the crosslinking agent, a sulfur-based crosslinking agent (vulcanizing agent), a peroxide, or some other in an appropriate amount into the composition. When silicone rubber is used as the matrix resin component, it is preferred to add a curing agent (such as a tertiary amine compound) for curing silicone. Furthermore, zinc oxide, active zinc oxide or the like may be added, as a curing accelerator, in an appropriate amount into the composition.

The amount of the additives is preferably set to 30% by mass or less of the whole of the anisotropic thermoconductive composition. The addition of the appropriate amount of the additives keeps a quantitative balance between the scaly graphite particles and the matrix resin component to maintain a good thermoconductivity of the composition easily and keep the shapeability and the strength thereof certainly.

<Content of the Scaly Graphite Particles>

The anisotropic thermoconductive composition contains the scaly graphite particles in a proportion more than 40% by mass. If the content of the scaly graphite particles is less than 40% by mass, the number of the contact portions between the particles is too small even when the particles have a peculiar shape as described above. Thus, a remarkable advantageous effect of increasing the contact area between the particles is not obtained. In other words, the anisotropic thermoconductivity of the composition containing the scaly graphite particles in a proportion of only 40% by mass or less becomes equivalent to that of a composition containing ordinary scaly graphite particles. If the content of the scaly graphite particles is 40% by mass or less, the thermoconductivity of the composition increases merely linearly approximately in proportion of the content of the graphite particles. However, when the anisotropic thermoconductive composition contains the scaly graphite particles in a proportion more than 40% by mass, the thermoconductivity of the composition non-linearly increases relatively to the content of the graphite particles. This would be based on a matter that the shape of the particles is a shape suitable for keeping, sufficiently and certainly, the contact area of the contact portions between the individual particles.

As the content of the scaly graphite particles contained in the anisotropic thermoconductive composition becomes larger than 90% by mass, there is generated a tendency that the shapeability of the composition is declined and further the composition becomes more brittle.

In order for the composition to attain a high thermoconductivity while the composition keeps a sufficient shapeability and strength certainly, the content of the scaly graphite particles contained in the composition is preferably 90% by mass or less, more preferably 80% by mass or less. The content of the scaly graphite particles contained in the composition is preferably more than 40% by mass, more preferably more than 43% by mass. The upper limits and lower limits of these preferred ranges may be combined with each other at will.

<Method for Producing the Planar Thermoconductive Sheet>

<First step>

An anisotropic thermoconductive composition is first prepared. The preparing method thereof is not particularly limited. The method may be merely a method of incorporating a matrix resin component, scaly graphite particles and optical additives in an appropriate order, and then kneading these components. However, when an elastomer (rubber component) is used as the resin component, it is desired to knead the components other than a crosslinking agent for the rubber initially so as not to advance the crosslinking of the rubber by heat generated in the kneading, and subsequently add the crosslinking agent for the rubber into the kneaded components and knead the individual components further.

The method for kneading the composition is not particularly limited, and may be, for example, a roll-kneading method. In the roll-kneading method, the composition is passed through a gap between paired rolls to be shaped into a sheet form. When the composition is sandwiched between the rolls to be passed through the gap, the composition receives shear force from the rolls that are being rotated so that the composition is stretched in a direction parallel to the rotating direction of the rolls. At this time, the matrix is stretched. Following the stretch, the scaly graphite particles dispersed in the composition are also oriented into the same direction. The orientation results in a state that the basal planes of the scaly graphite particles are oriented into the plane of the sheet. In order to heighten the orientation of the scaly graphite particles, it is preferred to pass the sheet between the rolls a plurality of times. When the sheet is sent out from the rolls in a state that the sheet adheres onto one of the rolls, it is preferred to peel the sheet from the roll, turn over the sheet, and then pass the sheet between the rolls.

Before the composition is kneaded by the roll-kneading method, the raw materials of the composition may be pre-kneaded by use of a closed-type kneader such as a Banbury mixer.

<Second step>

Next, the composition is shaped into a planar thermoconductive sheet having a desired thickness. The method for shaping into the sheet is not particularly limited as far as the method is a method capable of adjusting the thickness of the sheet. The method is preferably, for example, calendering since a sufficient pressure is applied to the sheet in the thickness direction according to this method so that the basal planes of the scaly graphite particles are easily oriented in the plane of the sheet.

The calendering is a method of supplying a composition continuously into a gap between at least one pair of rolls to be formed into a sheet, and then winding the sheet onto a winding roll. This method is suitable for continuous production. At a stage before the calendering, the composition may be rolled between hot rolls. By rolling, after the stage, the composition between cooling rolls, the precision of the thickness of the sheet can be made high.

After the composition is sufficiently kneaded by a closed-type kneader such as a Banbury mixer, the kneaded composition may be subjected to extrusion forming. In the extrusion forming, the composition is continuously extruded from a mouthpiece or mold matching with the shape of the sheet, thereby forming the composition into a sheet. In the extrusion, shear force directed to the extrusion direction is applied to the composition, thereby orienting the basal planes of the scaly graphite particles into the plane of the sheet. The sheet subjected to the extrusion forming may be further pressed between the calendering rolls.

When the composition contains a rubber component, the crosslinking (vulcanization) of the composition is advanced through reaction of the crosslinking agent by heating the composition optionally. In this way, a sheet is yielded which is excellent in flexibility and strength. Thereafter, the sheet is cut in a direction perpendicular to the plane thereof. In this way, products, such as heat-radiating sheets having a desired shape, can be obtained.

The crosslinking of the rubber component may be advanced by supplying a sufficient thermal energy to the composition when the composition is passed between the hot rolls in the calendering.

<Orientation of the Scaly Graphite Particles>

Figure 5:
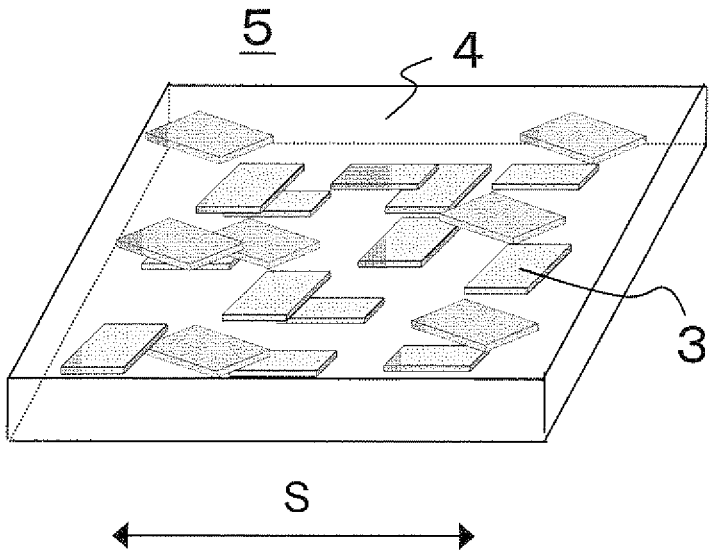
FIG. 5 is a schematic view illustrating a state that scaly graphite particles are oriented in an anisotropic thermoconductive composition.

FIG. 5 schematically illustrates an internal structure of the planar thermoconductive sheet 5 formed. The sheet 5 of the composition is composed of a matrix resin 4 and scaly graphite particles 3 dispersed in the matrix resin 4. As illustrated in FIG. 5, at the inside of the sheet 5 produced as described above, the scaly graphite particles 3 are oriented in such a manner that basal planes of the particles 3 and the plane S of the sheet 5 into substantially the same direction. Such an orientation state of the scaly graphite particles 3 can be verified by observing a cross section obtained by cutting the sheet 5 in a direction perpendicular to the plane S through a scanning electron microscope.

Figure 6:
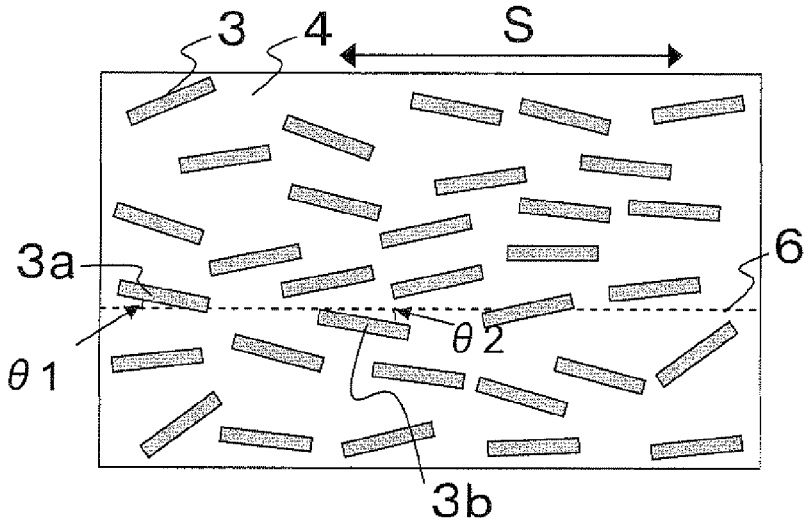
FIG. 6 is a schematic view illustrating a method for evaluating a state that scaly graphite particles are oriented.

FIG. 6 schematically illustrates a cross section of the sheet perpendicular to the plane S of the sheet 5 illustrated in FIG. 5. A broken line 6 in this figure is a base line drawn arbitrarily in a direction parallel to the plane S of the sheet 5 in order to measure the degree of the orientation of the scaly graphite particles. The orientation degree of the scaly graphite particles may be evaluated in accordance with the angle θ made between the base line 6 parallel to the plane S or the sheet 5 and the basal planes of the scaly graphite particles 3. It is noted that the angle θ is an acute angle, and further valued on the basis of the absolute value. Specifically, when, in FIG. 6, the angle (represented by θ1) made between the plane of a graphite particle 3*a* and the base line 6 is equal to the angle (represented by θ2) made between the plane of a graphite particle 3*b* and the base line 6, the orientation degree of the graphite particle 3*a* is equal to that of the graphite particle 3*b*.

The angle θ made between the basal planes of the scaly graphite particles 3 and the plane S of the sheet 5 is preferably 1° or more and 30° or less on average. When the angle θ is set to 1° or more on average, the number of the contact portions between the graphite particles is sufficiently ensured. Thus, a sheet having a high thermoconductivity can be obtained. In order to make the number of the contact portions between the graphite particles larger, the angle θ is more preferably 5° or more. When the angle θ is set to 30° or less, the scaly graphite particles 3 come to be oriented into such a degree that the thermoconductivity of the sheet 5 in the plane S can be made sufficiently large. By contrast, in the thickness direction of the sheet, the thermoconductivity is restrained.

The angle θ is the average value of angles of 20 of the scaly graphite particles. Specifically, about 20 particles selected at will from the scaly graphite particles observed on a cross section of the sheet that is perpendicular to the plane S of the sheet, the respective angles θ are measured, and then the average value may be calculated from the individual values.

Hereinafter, the invention will be more specifically described by way of working examples. However, the invention is not limited by the working examples.

Examples 1 to 4

(i) Production of Scaly Graphite Particles

A polyimide film of 25 μm thickness (KAPTON film, manufactured by Du Pont-Tray Co., Ltd.) was subjected to heat treatment in an argon gas atmosphere at 2600° C. for 4 hours to yield a graphite film. The resultant graphite film was pulverized by a jet mill over 15 minutes. The rotation number of its classifying section was set to 20000 when the film was pulverized. As a result, scaly graphite particles having the following shape were yielded.

The long diameter a: 5.5 μm on average.

The ratio of the long diameter a to the thickness c (a/c ratio): 100 on overage.

The ratio of the long diameter a to the short diameter b (a/b ratio): 2 on average.

(ii) Preparation of Anisotropic Thermoconductive Composition

The resultant scaly graphite particles were mixed with EPDM (ESPRENE, manufactured by Sumitomo Chemical Co., Ltd.), a peroxide crosslinking agent, and stearic acid, and the mixture was sufficiently kneaded through a two-roll kneader, the rolls each having a diameter of 8 inches, to prepare an anisotropic thermoconductive composition and further orient the plane P of the scaly graphite particles in the composition.

The content of the scaly graphite particles contained in each of the anisotropic thermoconductive compositions is shown in Table 1.

The amount of the peroxide crosslinking agent and that of stearic acid were set to 2% by mass of the composition and 0.3% by mass thereof, respectively, under each of the conditions for Examples 1 to 4. Thereafter, the two-roll kneader was used to shape the composition into a sheet of 1 mm thickness. Furthermore, the sheet was heated at 170° C. for 10 minutes to advance the vulcanization of the sheet.

Examples 5 and 6

A graphite film yielded under the same conditions as in Examples 1 to 4 was pulverized by a jet mill over 15 minutes in the state that the rotation number of its classifying section was set to 7000. As a result, scaly graphite particles having the following shape were yielded.

The long diameter a: 17 μm on average.

The ratio of the long diameter a to the thickness c (a/c ratio): 100 on overage.

The ratio of the long diameter a to the short diameter b (a/b ratio): 2 on average.

An anisotropic thermoconductive composition was then prepared in the same way as in Examples 1 to 4 except that the scaly graphite particles were incorporated into the composition to give a content in Table 1. The resultant was shaped into a sheet, and the vulcanization thereof was advanced.

Comparative Example 1

An anisotropic thermoconductive composition was prepared in the same way as in Examples 1 to 4 except that the same scaly graphite particles as used in Examples 1 to 4 were incorporated into the composition to give a content in Table 2. The resultant was shaped into a sheet, and the vulcanization thereof was advanced.

Comparative Example 2

An anisotropic thermoconductive composition was prepared in the same way as in Examples 5 and 6 except that the same scaly graphite particles as used in Examples 5 and 6 were incorporated into the composition to give a content in Table 2. The resultant was shaped into a sheet, and the vulcanization thereof was advanced.

Comparative Example 3 to 5

Comparative Examples 3 to 5 were each an example wherein scaly graphite particles manufactured by Chuetsu Graphite Works Co., Ltd. and having the following shape were used.

The long diameter a: 160 μm on average

The ratio of the long diameter a to the thickness c (a/c ratio): 12 on overage

The ratio of the long diameter a to the short diameter b (a/b ratio): 1 on average An anisotropic thermoconductive composition was prepared in the same way as in Examples 1 to 4 except that the above-mentioned scaly graphite particles were incorporated into the composition to give a content in Table 2. The resultant was shaped into a sheet, and the vulcanization thereof was advanced.

[Evaluation]

The working examples and the comparative examples were each evaluated about the thermoconductivity and the orientation of the scaly graphite particles in the ways described below. The results are shown in Tables 1 and 2.

Measurement of the Thermoconductivity:

The thermoconductivity of the sheet of each of the working examples and the comparative examples was measured.

A thermo wave analyzer (TA3, manufactured by Bethel Co., Ltd.) was used to measure the thermal diffusivity a by a periodic heating method. A main advantageous effect of the working examples was expected to be an improvement in the thermoconductivity in the plane of the sheet. Thus, about the main flat surfaces of the sheet, the direction in which the composition flowed when the composition was shaped into the sheet was defined as the X axis; a direction perpendicular to the X axis direction, as the Y axis; and the thickness direction of the sheet, as the Z axis. The thermoconductivity was measured about the Y axis direction perpendicular to the X axis direction, as well as about the X axis direction, along which shear force was applied. In this way, the effect of improving the thermoconductivity in the plane of the sheet was checked. The thermoconductivity a was calculated out in accordance with the following equation (1).

$$\alpha = \frac{\lambda}{\rho c} \tag{1}$$

α: thermal diffusivity

λ: thermoconductivity

ρ: density c: specific heat

<Measurement Conditions>

A sample obtained by cutting out the sheet into a size of 30 mm×30 mm was put onto a sample stand, and then measured.

<Thermoconductivities in the X and Y Axis Directions>

A laser, which is a thermal wave, is periodically radiated to the sample at a frequency of 0.5 Hz to 3 Hz. While a portion to be measured is varied from the laser-radiated portion to a portion 4 mm apart from the former portion, the phase difference of the temperature is was read out. Next, a graph is prepared wherein the distance is plotted along its transverse axis and the phase difference is plotted along its vertical axis. The gradient of the line on the graph is then analyzed. From the resultant gradient of the line, the thermal diffusivity is calculated out in accordance with an equation (2) described below.

<Thermoconductivity in the Z Axis Direction>

A laser, which is a thermal wave, is periodically radiated to the sample at a frequency of 0.1 Hz to 10 Hz, and the phase difference is read out. Next, a graph is prepared wherein the square root of the frequency is plotted along its transverse axis and the phase difference is plotted along its vertical axis. The gradient of the line on the graph is then analyzed. From the resultant gradient of the line, the thermal diffusivity is calculated out in accordance with an equation (3) described below.

$$\alpha = \frac{\pi f}{a^2} \quad (2)$$

$$\alpha = \frac{\pi d^2}{a^2} \quad (3)$$

α: thermal diffusivity
f: frequency
a: gradient of the line
d: thickness of the sample
Orientation:

The orientation of the scaly graphite particles in the sheet of each of the working examples and the comparative examples was checked on a scanning electron microscopic image (SEM image) of a cross section obtained by cutting the sheet in a direction perpendicular to the plane S of the sheet. Specifically, a base line parallel to the plane S of the sheet was drawn on the SEM image. A smaller angle θ out of angles were measured which were made between the base line and the basal planes of the scaly graphite particles.

TABLE 1

| | | Example 1 | Example 2 | Example 3 | Example 4 | Example 5 | Example 6 |
|---|---|---|---|---|---|---|---|
| Long diameter a (μm) | | 5.5 | 5.5 | 5.5 | 5.5 | 17 | 17 |
| Long diameter/thickness (a/c ratio) | | 100 | 100 | 100 | 100 | 100 | 100 |
| Long diameter/short diameter (a/b ratio) | | 2 | 2 | 2 | 2 | 2 | 2 |
| Content of graphite particles (% by mass) | | 40.9 | 48.5 | 50 | 53 | 40.9 | 50 |
| Thermoconductivity (W/m · K) | X direction | 10.1 | 23 | 24.4 | 24 | 11 | 22 |
| | Y direction | 7.4 | 18 | 23.7 | 23.2 | 6.8 | 21 |
| | Z direction | 0.24 | 0.5 | 0.6 | 0.4 | 0.32 | 0.7 |
| θ (°) | | 16 | 16 | 15 | 15 | 14 | 13 |

TABLE 2

| | | Comparative Example 1 | Comparative Example 2 | Comparative Example 3 | Comparative Example 4 | Comparative Example 5 |
|---|---|---|---|---|---|---|
| Long diameter a (μm) | | 5.5 | 17 | 160 | 160 | 160 |
| Long diameter/short diameter (a/c ratio) | | 100 | 100 | 12 | 12 | 12 |
| long diameter/short diameter (a/b ratio) | | 2 | 2 | 1 | 1 | 1 |
| Content of graphite particles (% by mass) | | 30.8 | 30.8 | 23 | 39 | 75 |
| Thermoconductivity (W/m · K) | X direction | 7.7 | 6.5 | 3.1 | 7 | 25 |
| | Y direction | 4.4 | 4.1 | 1.3 | 4.5 | 20 |
| | Z direction | 0.34 | 0.5 | 2.0 | 2.5 | 3.0 |
| θ (°) | | 15 | 16 | 17 | 19 | 17 |

Table 1 shows the content (% by mass) of the scaly graphite particles in the whole of the composition of each of the working examples, the respective thermoconductivities of the example in the X axis, the Y axis (plane) and the Z axis (thickness direction) of the sheet, and the average orientation degree (angle θ) of the scaly graphite particles in a cross section of the sheet that was parallel to the X axis direction; and Table 2 shows the same of each of the comparative examples.

First, it has been made evident about the thermoconductivities in the X axis and Y axis directions that the thermoconductivities each tend to increase as the content of the graphite particles is increased. This would be because the number of thermal conduction paths in the composition was increased by the increase in the number of the graphite particles for conducting heat in the plane.

It has also been made evident about the thermoconductivity in the Z axis direction that, similarly, the thermoconductivity increases as the content of the graphite particles is increased. The reason why the Z axis direction is lower in thermoconductivity than the X and Y axis directions is that the anisotropy of the graphite particles contributes to the lower thermoconductivity. The graphite particles exhibit respective high thermoconductivities in the X and Y axis directions (plane of the sheet); it is noted that the thermoconductivity in the Z axis direction (thickness direction of the sheet) is about 1/100 of each of the thermoconductivities in the plane. It appears that the Z axis direction is lower in thermoconductivity than the X and Y axis directions since the graphite particles, which are anisotropic material, are oriented in the plane inside the composition.

According to comparison of Examples 1 to 4 with Examples 5 and 6, no especial effect is not recognized when the long diameter a of the scaly graphite particles is changed from 5.5 μm to 17 μm on overage. The same tendency is observed not only in Examples 1 to 4, but also in Examples 5 and 6.

Figure 7:
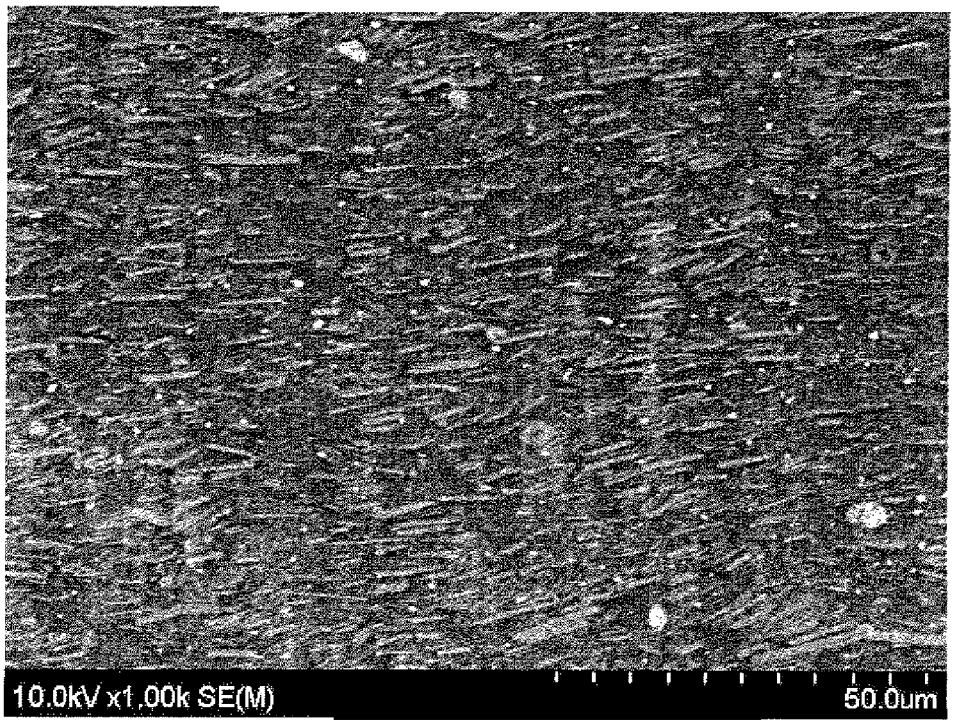
FIG. 7 is a SEM image of a cross section of a sheet made of a composition of Comparative Example 1, the cross section being parallel to the X axis direction of the sheet (the flowing direction of the composition when the sheet is formed)
Figure 8:
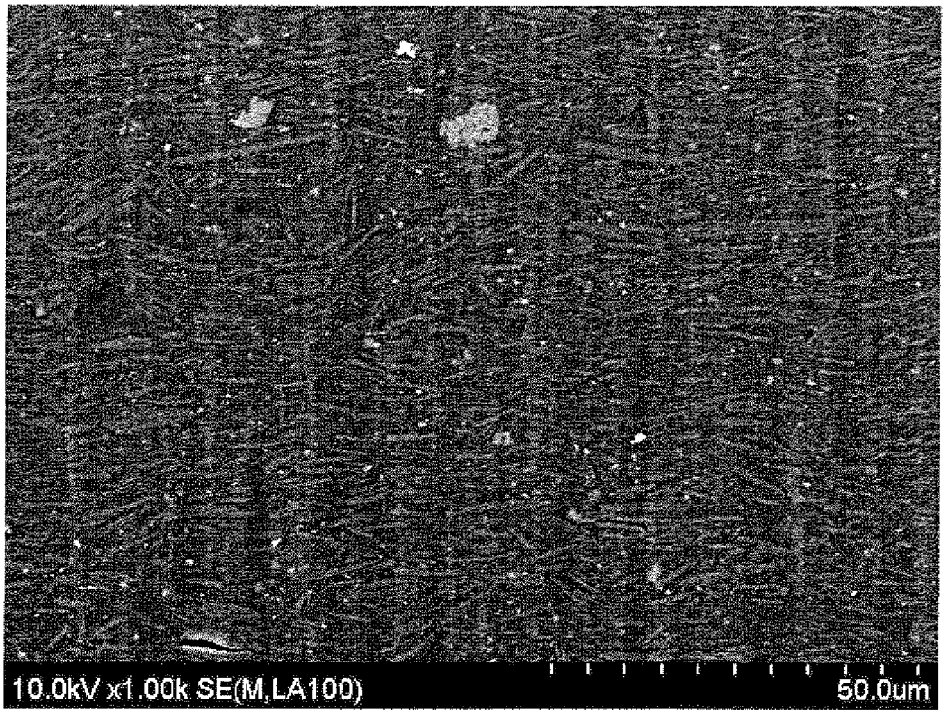
FIG. 8 is a SEM image of a cross section of a sheet made of a composition of Example 1, the cross section being parallel to the X axis direction of the sheet.
Figure 9:
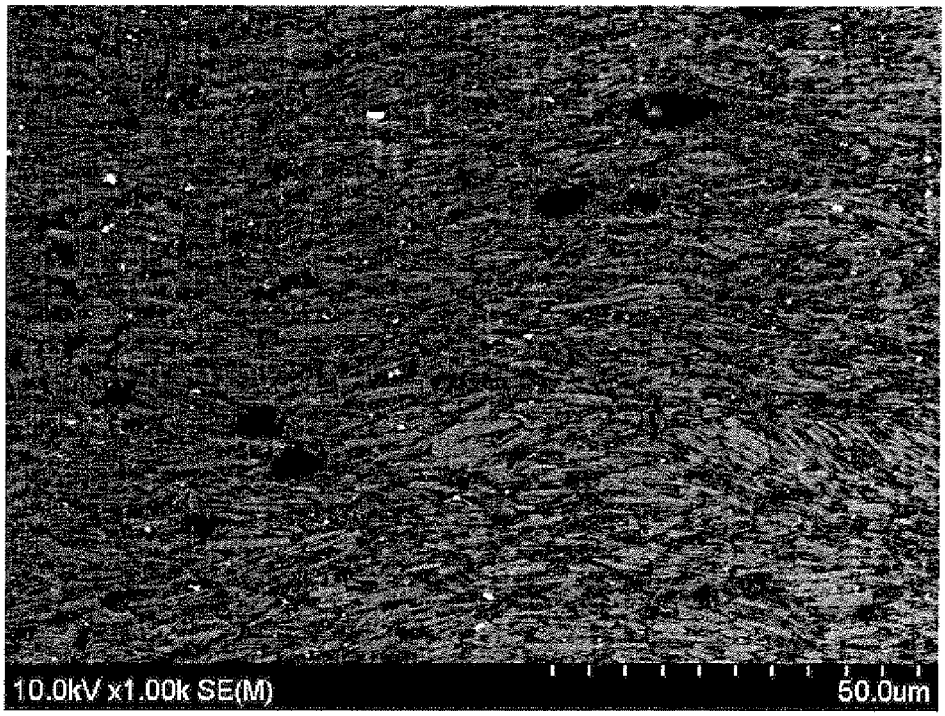
FIG. 9 is a SEM image of a cross section of a sheet made of a composition of Example 3, the cross section being parallel to the X axis direction of the sheet.
Figure 10:
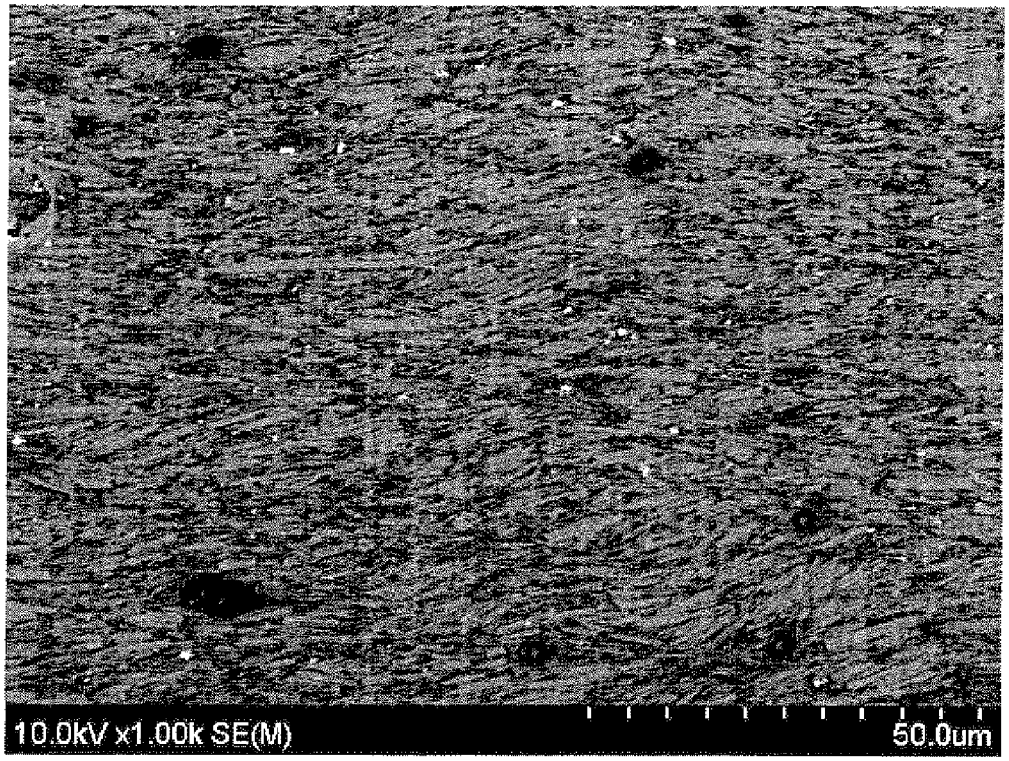
FIG. 10 is a SEM image of a cross section of the sheet made of the composition of Example 3, the cross section being parallel to the Y axis direction of the sheet (a direction perpendicular to the X axis direction)

FIGS. 7 to 9 each show a SEM image of a cross section of one of the resultant sheets, the cross section being parallel to the X axis direction of the sheet. FIG. 7 is a SEM image of Comparative Example 1; FIG. 8 a SEM image of Example 1; and FIG. 9 a SEM image of Example 3. FIG. 10 is a SEM image of a cross section of the sheet of Example 3, the cross section being parallel to the Y axis direction of the sheet.

From FIGS. 7 to 9, the situation is observed that the scaly graphite particles are dispersed in the matrix of the rubber component in the state of being oriented. It has also been made evident that an increase in the content of the graphite particles results in an increase in the number of contact portions between the graphite particles. FIGS. 9 and 10 have also demonstrated that the scaly graphite particles are oriented not only in the X axis direction but also in the Y axis direction.

Figure 11:
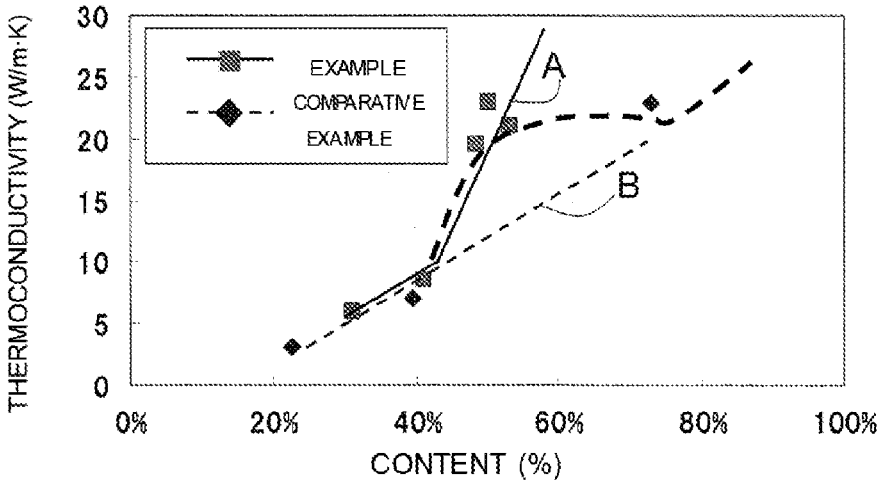
FIG. 11 is a graph showing a relationship between the content of graphite particles contained in a composition and the thermoconductivity of the sheet obtained from the composition, and line A therein represents the relationship about the compositions of Examples 1 to 4 and Comparative Example 1 while line B represents the relationship about the compositions of Comparative Examples 3 to 5.

FIG. 11 is a graph showing a relationship between the content (transverse axis) of the graphite particles in the whole of the composition, and the thermoconductivity (vertical axis) of the sheet obtained from the composition. A line A therein is a line obtained by plotting, about the compositions of Examples 1 to 4 and Comparative Example 1, the relationship. A line B is a line obtained by plotting, about the compositions of Comparative Examples 3 to 5, the relationship. When the content of the ordinary scaly graphite particles is increased, an increase in the thermoconductivity is linear. By contrast, about the scaly graphite particles satisfying the requirements of the present working examples, the increase rate of the thermoconductivity is largely changed when the content turns into more than 40% by mass.

The reason why a nonlinear behavior as described above is obtained is viewed or presumed herein.

The thermoconductivity-improving effect is attained by increasing the number of contact portions between the scaly graphite particles or the contact area therebetween. In the graphite particles about which the ratio of the long diameter a to the thickness c of the particles (a/c ratio) and the ratio of the long diameter a to the short diameter b (a/b ratio) are large, a scope where the particles are movable becomes larger when the particles are oriented in the composition than in the graphite particles about which the a/c and a/b ratios are small. However, in a case where the distance between the particles is relatively large even when the particle-movable scope is large, the following probability is not varied very much between cases where the shape of the particles are different: a probability that any one of the particles contacts particles present around the particle when the entire particles are oriented. When the distance between the particles becomes smaller to some degree, the effect based on the particle shape emerges. A critical point at which the effect based on the particle shape starts to emerge is a point where the content is about 40% by mass.

Embodiment 2

A wear according to Embodiment 2 is different from the wear according to Embodiment 1 in that a sheet made of graphite is used as a planar thermoconductive sheet. This graphite sheet may be a graphite film obtained by firing a polymer film, which is a precursor of the scaly graphite particles of the planar thermoconductive sheet used in the wear according to Embodiment 1.

The step of yielding the graphite film is equivalent to the above-mentioned step. Thus, any description thereon is omitted. The polymer film, which is a starting material, is also equivalent to the above-mentioned polymer film. Thus, any description thereon is omitted.

Hereinafter, a description will be made about Examples 7 and 8 and Comparative Example 6 each related to a wear.

Example 7

Figure 12A:
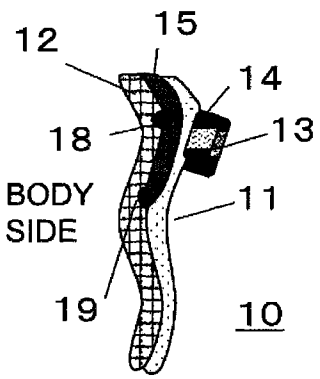
FIG. 12A is a sectional view illustrating a sectional structure of a wear of Example 7.
Figure 12B:
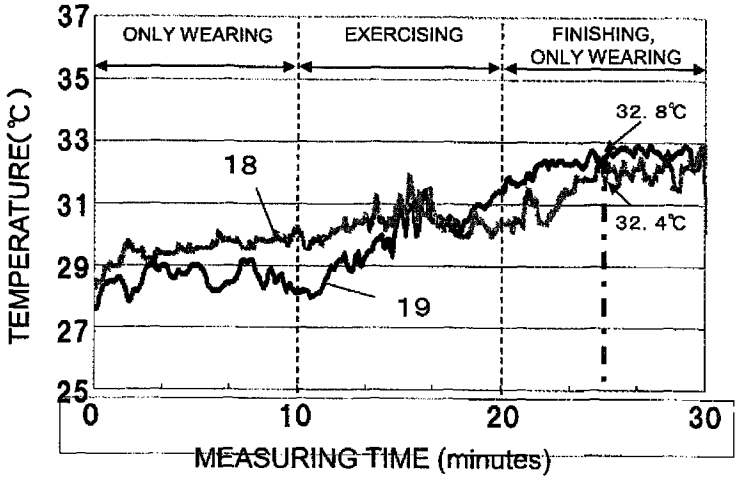
FIG. 12B is a graph showing a change in the temperature of each of measuring portions 1 and 2 of the wear of FIG. 12A before, when and after a person wearing the wear exercised.

FIG. 12A is a sectional view illustrating a sectional structure of a wear 10 of Example 7, and FIG. 12B is a graph showing a change in the temperature of each of first and second measuring portions (18) and (19) of the wear 10 before, when and after a person wearing the wear 10 exercised. The wear 10 of Example 7 was formed as a wear in a vest form. A coolant 14 was arranged in a storage pocket 13 attached to a frontal land 11, and a planar thermoconductive sheet 15 which was a sheet made of graphite (the proportion of graphite: 100%) was located between the frontal land 11 and a rear land 12.

Before, when and after the person wearing this wear 10 exercised, measurements were made about the respective temperatures of the first measuring portion (18) near the coolant 14 and the second measuring portion (19) apart from the coolant 14. In FIG. 12B, the respective temperatures of these measuring portions are plotted along the lapse of time. As shown in FIG. 12B, by the exercise, the temperature of the whole of the body was slightly raised; however, the temperature change of the second measuring portion (19) apart from the coolant was substantially equal to that of the first measuring portion (18) near the coolant 14. As illustrated in FIG. 3, for example, after 25 minutes elapsed from the finish of the exercise, the temperature of the first measuring portion (18) was 32.4° C., and that of the second measuring portion (19) was 32.8° C. This was presumed as follows: through the planar thermoconductor 15 located between the frontal land 11 and the rear land 12 of the wear 10, heat from the second measuring portion (19) apart from the coolant 14, as well as heat from the first measuring portion (18) near the coolant 14, was conducted to the coolant 14 so that the surface temperature of the whole of the body was able to be equalized.

Example 8

As compared with the wear 10 of Example 7, a wear 10 of Example 8 was different therefrom in that a planar thermoconductive sheet 15 was a sheet made of the same anisotropic thermoconductive composition as used in Example 1.

As shown in Table 3, for example, after 25 minutes elapsed from a time when a person wearing the wear finished exercising, the temperature of its first measuring portion (18) was 32.3° C., and that of its second measuring portion (19) was 33.6° C. This was presumed as follows: through the planar thermoconductor 15 located between a frontal land 11 and a rear land 12 of the wear 10, heat from the second measuring portion (19) apart from the coolant 14, as well as heat from the first measuring portion (18) near the coolant 14, was conducted to the coolant 14 so that the surface temperature of the whole of the body was able to be equalized.

Comparative Example 6

Figure 13A:
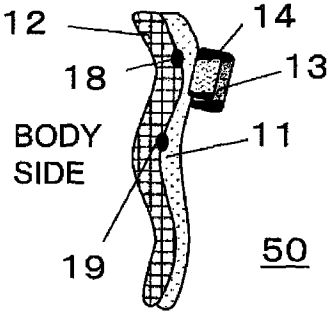
FIG. 13A is a sectional view illustrating a sectional structure of a wear of Comparative Example 6.
Figure 13B:
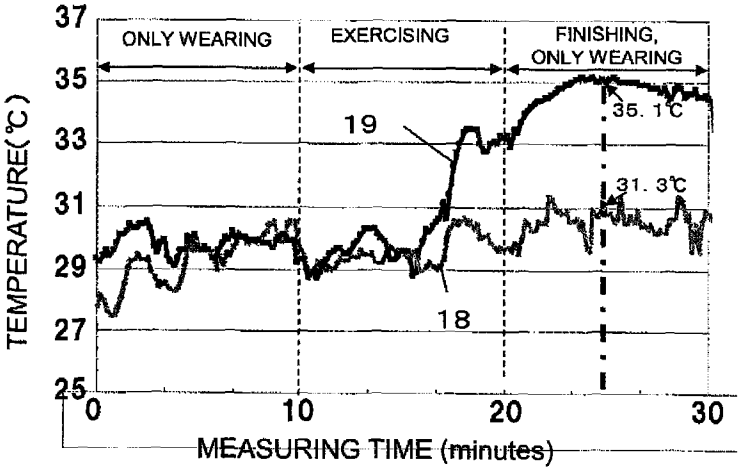
FIG. 13B is a graph showing a change in the temperature of each of measuring portions 1 and 2 of the wear before, when and after a person wearing the wear exercised.

FIG. 13A is a sectional view illustrating a sectional structure of a wear 50 of Comparative Example 6, and FIG. 13B is a graph showing a change in the temperature of each of first and second measuring portions of the wear 50 before, when and after a person wearing the wear 50 exercised. As compared with the wears according to Examples 7 and 8, the wear 50 according to Comparative Example 6 was common in that a coolant was arranged but was different in that no planar thermoconductive sheet was located.

As illustrated in FIG. 13B, as the temperature of the whole of the body was raised by the exercise, the temperature of the first measuring portion (18) near the coolant 14 did not change very much while that of the second measuring portion (19) apart from the coolant 14 was rising when the person was exercising, and showed a large difference of about 4° C. from the temperature of the first measuring portion (18) after the person finished exercising. As shown in Table 3, for example, after 25 minutes elapsed from the finish of the exercise, the temperature of the first measuring portion (18) was 31.3° C., and that of the second measuring portion (19) was 35.1° C. This was presumed as follows: between a frontal land 11 and a rear land 12 of the wear 50, no planar thermoconductor 15 was located so that only the first measuring portion (18) near the coolant 14 was cooled; by contrast, heat from the second measuring portion (19) apart from the coolant 14 remained as it was at the second measuring portion (19) so that a large temperature difference was generated between the first measuring portion (18) and the second measuring portion (19).

Table 3 shows the temperature of the first measuring portion (18) and that of the second measuring portion (19) after 25 minutes elapsed from the time when the person wearing the wear of each of Examples 7 and 8 and Comparative Example 6 finished exercising.

TABLE 3

| | Planar thermoconductive sheet | First Measuring portion 1 (° C.) | Second Measuring portion 2 (° C.) |
|---|---|---|---|
| Example 7 | Graphite sheet (the proportion of graphite: 100%) | 32.4 | 32.8 |
| Example 8 | Anisotropic thermoconductive composition (scaly graphite particles + matrix resin) | 32.3 | 33.6 |
| Comparative Example 6 | None | 31.3 | 35.1 |

Embodiment 3

Clothings (a cap and a helmet) according to Embodiment 3 are examples wherein any one of the planar thermoconductive sheets used in the clothings (wears) of Embodiments 1 and 2 is applied to a cap 100 and a helmet 101.

Figure 14:
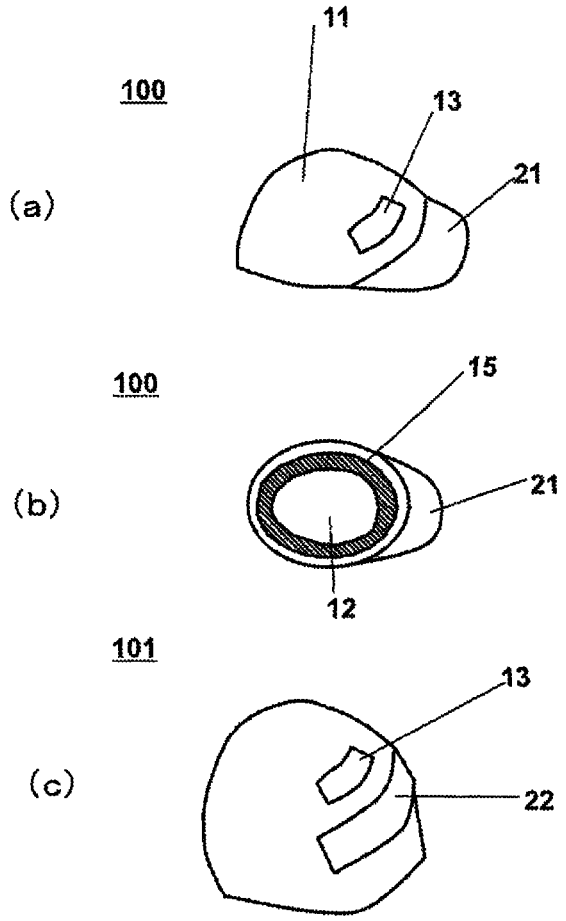
FIG. 14A is a perspective view of the front side of a cap according to Embodiment 3.
FIG. 14B is a bottom view of the rear side of the cap in FIG. 14A.
FIG. 14C is a perspective view of a helmet according to Embodiment 3.

FIG. 14A is a perspective view of the front side of the cap 100 according to Embodiment 3. FIG. 14B is a bottom view of the rear side of the cap 100 in FIG. 14A. In the same manner as in Embodiments 1 and 2, a planar thermoconductive sheet 15 is located between a frontal land 11 and a rear land 12 of the cap 100. A storage pocket 13 is attached to a front curved surface of the cap 100 (a portion of the cap 100 over a brim 21). However, the position to which the storage pocket 13 is attached is not limited to this position, and thus the pocket 13 may be attached to a rear curved surface of the cap 100. A thermal storage unit 14 is inserted into the storage pocket 13. In this way, heat from a cooling source or heating source used as the thermal storage unit 14 is spread through the planar thermoconductive sheet 15 to the inside of the cap 100.

In this example, the planar thermoconductive sheet 15 is arranged at the side of the cap 100 to make it possible to cool or warm the side of the head of a person who puts on the cap 100.

The planar thermoconductive sheet 15 and the others may be the same as used in Embodiment 1 or 2.

FIG. 14C is a perspective view of the helmet 101 according to Embodiment 3. The helmet 101 is a wear to which any one of the planar thermoconductive sheets 15 used in the wears of Embodiments 1 and 2 is applied. In the same manner as illustrated in FIG. 14A, a storage pocket 13 is attached to a front side of the helmet (a portion of the helmet over a transparent cover 22). A thermal storage unit 14 is inserted into the storage pocket 13 so that heat from the thermal storage unit 14 can be spread to the inside of the helmet 101.

In the same manner as illustrated in FIG. 14B, the planar thermoconductive sheet 15 is located to the circumference of the inside of the helmet 101, so that the side of the head of a person putting on the helmet 101 can be cooled or warmed, which situation is not illustrated.

In this example, the planar thermoconductive sheet 15 is in a slenderly rectangular line form, and is extended from the storage pocket 13 into two directions. Through the line, heat is conducted.

As described above, examples of the clothing of the invention include not only wears as described in Embodiments 1 and 2 but also caps and helmets as described in Embodiment 3, and analogues thereof.

The invention has been sufficiently described in connection with the preferred Embodiments with reference to the drawings. However, it is evident that those skilled in the art can change or modify the Embodiments variously. It should be understood that such changed or modified Embodiments are included in the scope of the invention, which is specified by the appended claims, as far as the Embodiments do not depart from the scope.

The clothing having a frontal land and a rear land according to the disclosures, includes: a thermal storage unit; and a planar thermoconductive sheet located between the frontal land and the rear land, the planar thermoconductive sheet having a thermal conduction path to the thermal storage unit, and the planar thermoconductive sheet being high in thermoconductivity in the plane. Thermal conduction generated by a difference in temperature between a person wearing this clothing and the thermal storage unit is introduced through the planar thermoconductive sheet, which has a high thermoconductivity in the plane, thereby making it possible to control the temperature of the body surface of the person to a comfortable temperature. Thus, the clothing is useful as a clothing having a cooling or warming function.

What is claimed is:

1. An article of clothing having a frontal land and a rear land, comprising:

a thermal storage unit provided on at least one portion of the frontal land side of the clothing; and one plane thermoconductive sheet located in a plane between the frontal land and the rear land, the one planar thermoconductive sheet having a thermal conduction path to the thermal storage unit, and the one planar thermoconductive sheet is formed of a material having a higher thermoconductivity than the frontal land and the rear land, wherein the one planar thermoconductive sheet includes a resin component and scaly graphite particles, wherein the one planar thermoconductive sheet has four branches connected by first and second base regions, wherein the four branches of the one planar thermoconductive sheet correspond to first and second branches extending from the first base region, and third and fourth branches extending from the second base region, wherein the thermal storage unit comprises:

a first thermal storage unit that is in contact with the first base region; and a second thermal storage unit that is in contact with the second base region, and wherein the first, second, third and fourth branches extend in different directions from each other.

2. The article of clothing according to claim 1, wherein each of the first and second branches has a length shorter than the third and fourth branches, and each of the first and second branches has a width wider than the third and fourth branches.

3. The article of clothing according to claim 1, wherein an angle θ between a basal plane of each of the scaly graphite particles and a plane of the one planar theremoconductive sheet is 1° or more and 30° or less on average.

4. The article of clothing according to claim 1, wherein an angle θ between a basal plane of each of the scaly graphite particles and a plane of the one planar theremoconductive sheet is 13° or more and 16° or less on average.

5. The article of clothing according to claim 1, wherein each of the first and second branches has a width wider than the third and fourth branches.

6. The article of clothing according to claim 5, wherein the first thermal storage unit is in direct contact with the first base region, and wherein the second thermal storage unit is in direct contact with the second base region.

* * * * *